US005159719A

United States Patent [19]

Aumann

[11] Patent Number: 5,159,719

[45] Date of Patent: Nov. 3, 1992

[54] WATERPROOF GARMENT

[75] Inventor: Hans Aumann, Bruckmühl, Fed. Rep. of Germany

[73] Assignee: W. L. Gore & Associates, Inc., Newark, Del.

[21] Appl. No.: 718,069

[22] Filed: Jun. 20, 1991

[51] Int. Cl.[5] ..... A41D 3/04

[52] U.S. Cl. ..... 2/87; 2/82; 2/96

[58] Field of Search ..... 2/2, 69, 82, 85, 87, 2/93, 96, 97, 243 R, 272, 274, 275

[56] References Cited

U.S. PATENT DOCUMENTS

| | | | |
|---|---|---|---|
| 1,178,701 | 4/1916 | Barker | 2/87 |
| 3,090,047 | 5/1963 | De Grazia | 2/87 |
| 3,449,764 | 6/1969 | De Fazio | 2/96 |
| 4,274,159 | 6/1981 | Schmidt | 2/2 |
| 4,604,759 | 8/1986 | Bowman | 2/87 |
| 5,003,902 | 4/1991 | Benstock | 2/87 |

FOREIGN PATENT DOCUMENTS

| | | | |
|---|---|---|---|
| 563651 | 9/1958 | Canada | 2/93 |
| 2918887 | 11/1979 | Fed. Rep. of Germany | 2/87 |
| 2458238 | 2/1981 | France | 2/82 |
| 1379635 | 1/1975 | United Kingdom | 2/87 |
| 1418461 | 12/1975 | United Kingdom | 2/87 |
| 1583447 | 1/1981 | United Kingdom | 2/82 |

*Primary Examiner*—Werner H. Schroeder
*Assistant Examiner*—Diana L. Biefeld
*Attorney, Agent, or Firm*—Gary A. Samuels

[57] ABSTRACT

In order to protect a waterproof garment from the ingress of water via water bridges formed in the area of its closure 15, the inner surfaces of an outer flap 29 and an intermediate flap 41 and the two surfaces of connecting inner face laminates 61*b*, 63*b* extending between an outer flap seam 31 and one side of the closure 15 or an intermediate flap seam 43 and the other side of the closure 15 are each formed by a monofil knit and furthermore waterproof seam-sealing tapes 79*a*, 71*b*, 73*a*, 73*b* are applied to the angles between each garment part 11*a*, 11*b* and the connecting inner face laminates 61*b*, 63*b* on the one hand and between the flap 29 or the intermediate flap 41 and the connecting inner face laminates 61*b*, 63*b*.

7 Claims, 1 Drawing Sheet

WATERPROOF GARMENT

FIELD OF THE INVENTION

The invention relates to a waterproof garment.

BACKGROUND OF THE INVENTION

Waterproof garments such as jackets and coats are generally produced with a shell material made of rubber or waterproof plastics. Since the rubber or plastic shell was impermeable to moisture produced by perspiration from the wearer's body, the wear comfort was not satisfactory. For some years there have been waterproof garments incorporating a waterproof yet water permeable functional layer between the textile face fabric and the textile lining fabric which are both made of material permeable to water. This functional layer may e.g. consist of expanded polytetrafluoroethylene (PTFE) which has been made microporous by a special expansion process.

The problem of waterproof garments are the seams, where the waterproof layer is perforated and the sewing threads conduct water which falls onto the face fabric through the waterproof layer up the inner lining by means of a capillary or wicking effect. Since normal lining fabrics consist of materials capable of absorbing large quantities of water, the lining will be perceivably moist only a short time after exposure of the garment to rain. One solution is to sew through the face fabric but avoid sewing through the functional layer. However, this will not always be possible. In case it is unavoidable to stitch through the functional layer, a tape made of waterproof plastic material is used to seal the inner side of the functional layer. Such a seam-sealing tape, however, cannot be applied to the textiles commonly used for face fabrics and lining fabrics.

Closures by means of which the garment can be opened and closed, such as zippers are a problem for waterproof garments. On the one hand, water can penetrate between the individual teeth of the zipper, on the other hand the textile material at both sides of the zipper which serves to sew the zipper to the fabric of the garment, is not waterproof. For this reason, more and more waterproof garments are provided with flaps which cover the zipper or closure when the garment is closed. Such flaps are usually made of the same textile material as the face fabric of the main part of the garment to impart a good look to the garment. In order to prevent water which has reached the free end of the flap and the part of the face fabric below from penetrating the closure, an intermediate flap can be provided which is located between the closure and the flap when the garment is closed.

A well known example for such a construction is an anorak-type jacket as shown schematically and sectionally in FIG. 1. The garment comprises two main parts 11*a* and 11*b* which are linked by means of a closure in the form of a zipper 15 so that the garment can be opened and closed. In the embodiment shown in the drawing, both main garment parts 11*a* and 11*b* are of three-layer construction. The outer side is formed by a textile face fabric 16*a*, 16*b*. The inner side is a lining 17*a*, 17*b*. Between the face fabric 16*a*, 16*b* and the lining 17*a*, 17*b* there is a waterproof functional layer 19*a*, 19*b* e.g. made of expanded microporous PTFE which allows water vapor to penetrate. At their free ends the main garment parts 11*a* and 11*b* are attached to textile support strips 21*a* and 21*b* of zipper 15 by means of zipper seams 25*a* and 25*b*. An outer flap 29 is sewn to the main garment part 11*a* by means of a flap seam 31. The outer flap 29 comprises an outer face fabric 33*a* and an inner face fabric 33*b*. Between these there is arranged a waterproof, water-vapor permeable functional layer 37. The inner face fabric 33*b* is formed by turning the outer face fabric 33*a* around the free end of the functional layer 37 and sewing the folded face fabric by means of the outer flap seam 31. Furthermore, the outer face fabric 33*a*, the inner face fabric 33*b* and the intermediate functional layer 37 are sewn together by means of an outer flap end seam 39.

An intermediate flap 41 is sewn to the main garment part 11*b* by means of an intermediate flap seam 43. Like the outer flap 29 the intermediate flap 41 is also of three-layer construction, with an outer face fabric 45*a*, an inner face fabric 45*b* and an intermediate functional layer 49. In order to prevent water from reaching the zipper, the intermediate flap 41 is folded once over its entire width at the side adjacent to the outer flap seam 31 so that it covers the zipper 15 in two layers. There is some space left between the free ends of the intermediate flap 41 and the outer flap 29 so that a closing mechanism in the form of waterproof snap fasteners 59 can be provided.

At first sight it looks as if the ingress of water from outside into the garment via the zipper area can be prevented by the outer flap and the folded over intermediate flap 41. Experience has, however, shown that water bridges remain which allow the water to penetrate through to the lining 17*a*, 17*b* so that the inner side of the garment becomes moist in rain. The object of the invention is to improve a waterproof garment of the described type in such a way that water can no longer reach the inner side of the garment. The first step towards the present invention was to find out how such water bridges are created. Textile materials which are used as face fabrics for garments of the mentioned type are not only permeable to water through the material but also allow water to creep along the material in a longitudinal direction. When water contacts the surface of the main garment part 11*a*, it can creep along the surface of face fabric 16*a* below the outer flap 29 up to the zipper seam 25*a*.

Here it creeps through the seam stitches and the threads of the zipper seam 25*a* through the functional layer 19*a* down to the lining 17*a*. In the lining 17*a* which normally consists of a textile material which is even more absorbent than conventional face fabrics, the water can spread. Some time after the garment has become wet from outside there are moist areas at the inside of the lining.

The same water conducting mechanism occurs at the other side of the zipper 15. Water which has contacted the face fabric 16*b* of the main garment part 11*b* can penetrate under the intermediate flap 41 towards the zipper seam 25*b* due to the wicking effect of the face fabric and reach the lining 17 of the main garment part 11*b* through the seam stitches and threads of this seam.

SUMMARY OF INVENTION

The combination of characteristics described in this invention effectively prevents the creation of water bridges from the outside of the garment towards the inside of the lining fabric. Monofil knits used for the inner surface of the outer flap and the intermediate flap and the two surfaces of the two connecting inner face laminates do not only offer the advantage of a considerably reduced wicking effect compared to multifil knits as they are conventionally used for face fabrics but also the seams can be sealed by conventional waterproof tape. Furthermore, the wicking effect is broken wherever such a tape is applied to the monofil knit.

According to the invention both the inner surface of the outer flap and the intermediate flap as well as both surfaces of the connecting inner face laminates are formed by monofil knits, both the acute angles between the outer flap and the connecting inner face laminate and between the intermediate flap and the connecting inner face laminate, and the obtuse angles between each connecting inner face laminate and the adjacent main part of the garment can be sealed by a tape each in the area of the outer flap seam or the intermediate flap seam.

Thus this invention comprises a waterproof wearing garment having a closure means for closing the garment around the body wherein:

The closure means is a zipper 15,

The zipper is covered by flaps (29 and 41) extending from each of the main garment parts (11*a* and 11*b*) on either side of the zipper, each flap being sewn (31 and 43), to the main garment part, each flap having an extension (61*b* and 63*b*) extending inwardly from the seams (31 and 43) and connecting with zipper support strips (21*a* and 21*b*), said assembly extending extensions (61*b* and 63*b*) forming an acute angle and an obtuse angle with its flap; and waterproof tape covering the area formed by the angles.

In a specific embodiment a waterproof garment is provided which comprises a textile face fabric 16*a*, 16*b*, a textile lining 17*a*, 17*b*, and a waterproof functional layer 19*a*, 19*b* arranged in between. The garment is equipped with a re-openable closure 15 in the form of a zipper to open and close the garment with an outer flap 29 which is linked with a main garment part 11*a* adjacent to a longitudinal side of the closure, said outer flaps being located above the closure when the garment is closed, and with an intermediate flap 41 which is linked with a main part 11*b* adjacent to another longitudinal side of the closure 15, being located between closure 15 and the outer flap 29 when the garment 15 closed, with the outer sides of the flap 29 and the intermediate flap 41 each consisting of a textile face fabric 33*a*, 45*a* and the inner sides consisting of inner face laminates 61*a*, 63*a* containing a functional layer, and with an outer flap seam 31 running parallel to the closure 15 at the place where the intermediate flap 41 is connected with the main garment part 11*b*.

The inner face laminates 61*a*, 63*a* of the outer flap 29 and the intermediate flap 41 are free from face fabric at least in the region running parallel and adjacent to the outer flap seam 31 or the intermediate flap seam 41, and a connecting inner face laminate 61*b*, 63*b* is arranged on both sides of the closure 15 and which is sewn to face fabric 16*a*, 16*b* at the inner side of the waterproof layer 19*a*, 19*b* of the main garment parts 11*a*, 11*b* by means of the outer flap seam 31 and the intermediate flap seam 43 at one end and which is connected at the other end together with the lining 17*a* and 17*b* of the main garment parts 11*a*, 11*b* to both sides of the closure 15, the surface of the inner face laminate being made of a monofil knit and wherein along the flap seam 31 and the intermediate flap seam 43 a first waterproof seam tape is applied to the obtuse angle formed by the inner side of the functional layer 19*a*, 19*b* and the inner surface of the corresponding connecting innerface laminate 61*b*, 63*b* along the outer flap seam 31, and a second waterproof seam tape is applied to the acute angle formed by the inner side of the outer flap 29 and the intermediate flap 41 and the outer surface of the corresponding connecting inner surface laminate 61*b*, 63*b*.

DESCRIPTION OF THE INVENTION

The main reason for the high wicking effect of multifil knits is that channels with a capillary effect are generated between the individual threads which as a bundle constitute a single multifil thread. Compared to that, individual threads would have a much reduced wicking effect. Monofil knits comprise individual threads instead of bundles of threads, which explains why the wicking effect is much lower. The main cause of wicking occurring with monofil threads is the interstices between the individual monofil textile threads created during weaving or knitting. Since these interstices are much larger than those within a bundle of threads comprising one multifil thread, the material of conventional seam tapes can fill them so that water bridges are eliminated.

Wherever a waterproof seam tape is applied to a monofil knit the relatively slight wicking effect of monofil knits is completely eliminated.

All these measures prevent the creation of water bridges that might cause the ingress of water through to the garment lining in a garment constructed as described in the invention. Water contacting the fact fabric of the parts of the garment adjacent to the outer flap and the intermediate flap can in the worst of cases reach the free ends of the outer flap and the intermediate flap due to the wicking effect of the face fabric material. From here it would have to overcome the monofil knit with its low absorbency. Even if moisture reaches the vicinity of the area connecting the outer flap with one of the connecting inner face laminates or the intermediate flap with the other connecting inner face laminate, it will be stopped by the seam tape. Water which contacts the face fabric and penetrates the outer flap seam or the intermediate flap seam can penetrate the functional layer of the main part of the garment which is stitched through and contains sewing threads up to the corresponding connecting inner face laminate. However, since both surfaces of the connecting inner face laminates consist of a monofil knit and are sealed by seam tapes, there can be no water bridges reaching the ends of the connecting inner face laminates which are linked with the closure of the garment. Therefore, water cannot reach the zipper means by means of which the closure is attached to the connecting inner face laminates and the lining and therefore cannot reach the inner lining of the garment.

The invention therefore prevents the ingress of water to the inner side of a garment to a high degree of safety. The invention will now be explained in more detail using a particular embodiment as an example.

Figure 1:
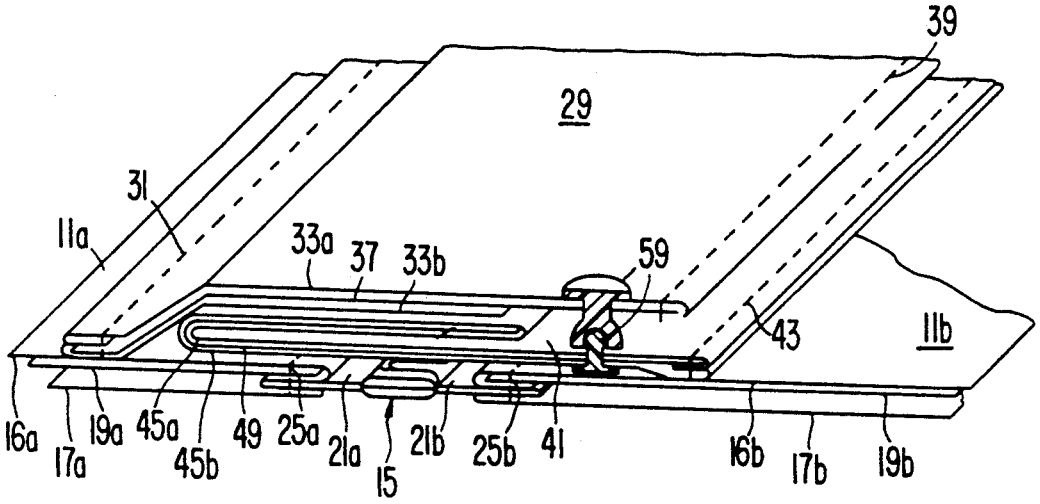
FIG. 1 PRIOR ART
FIG. 1 is a conventional garment in sectional schematic view.
Figure 2:
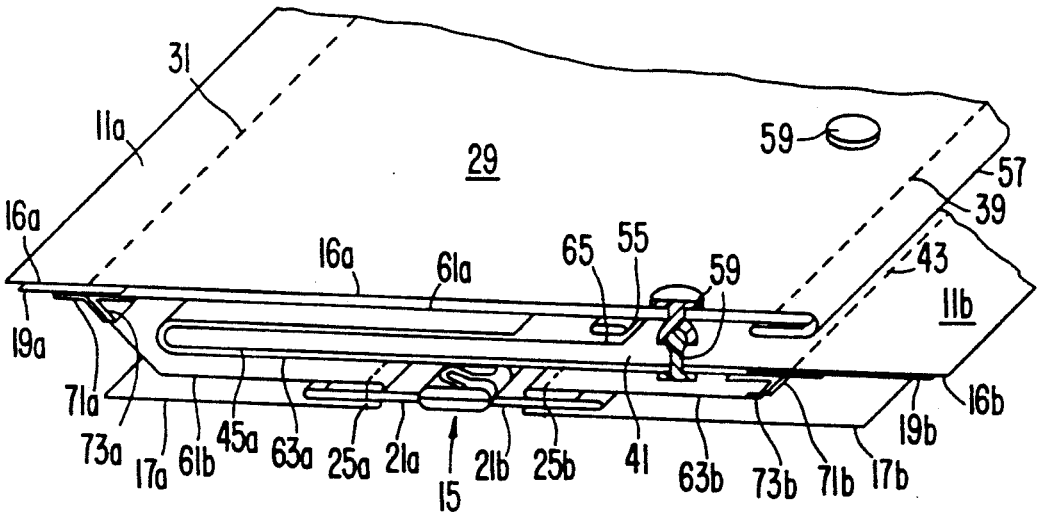
FIG. 2 is an embodiment of a garment according to the invention in schematic sectional view.

In the embodiment of the invention shown in FIG. 2 any parts conforming to the garment shown in FIG. 1 are marked by the same reference numbers as used in FIG. 1.

As in FIG. 1 an outer flap 29 is connected with the main garment part 11a and an intermediate flap 41 is connected with the main garment part 11b.

In contrast to the known construction shown in FIG. 1 the outer flap 29 and the intermediate flap 41 in FIG. 2 are not constructed as sewn-on flaps but as extensions of the face fabric 16a and 16b from the main garment parts 11a and 11b. It should be pointed out however that the invention also allows for the outer flap 29 and/or the intermediate flap 41 as a sewn-on construction.

In this case the face fabric 16a and 16b of the main garment parts 11a and 11b would stop somewhat beyond the outer flap seam 31 and somewhat beyond the intermediate flap seam 43 and the outer flap 29 and the intermediate flap 41 would be sewn on to the ends of the face fabric 16a and 16b created by this construction, of the main garment parts 11a and 11b.

In contrast to the known construction as shown in FIG. 1 the inner face laminate 61a of the outer flap 29 and the inner face laminate 63b of the intermediate flap 41 are formed by a three-layer laminate comprising a waterproof layer in the middle and at both sides of this layer a monofil knit (not separately shown in FIG. 2). One end of the inner face laminate 61a of the outer flap 29 is sewn to the face fabric 16a of the outer flap 29 at the outer flap end means 39, the other end is sewn at the outer flap seam 31. The inner face laminate 63a of the intermediate flap 41 is sewn to the outer face fabric 45a of the intermediate flap 41 of the intermediate flap end seam 65 located at the free end 55 of the intermediate flap and is also sewn at the intermediate flap seam 43.

The waterproof functional layer of the inner face laminates 61a and 63b is preferably formed by a waterproof, water-vapor permeable functional layer which may be porous expanded PTFE. The inner face laminate 61a of the outer flap 29, however, does not stop at the outer flap seam 31 but forms a connecting inner face laminate 61b which is sewn together with the textile strip 21a of the zipper 15 and the free end of the lining 17a by means of the zipper seam 25a. In the same way, the inner face laminate 63a of the intermediate flap 41 does not stop at intermediate flap seam 43 but forms a connecting inner face laminate 63b which is sewn to the textile strip 21b of the zipper 15 by the zipper seam 25b and to the free end of the lining 17b of the main garment part 11b.

The connecting inner face laminates 61b, 63b do not have to be a continuation of the inner face laminates 61a and 63a but may also form a separate three-layer laminate which is sewn to the main garment part 11a and the outer flap 29 by means of the outer flap seam 31 and attached to the main garment part 11b and the intermediate flap 41 by means of the outer flap seam 43.

As shown in FIG. 2, the two connecting inner face laminates 61b and 63b form an obtuse angle each with the main garment parts 11a and 11b and an acute angle each with the outer flap 29 and the intermediate flap 41.

In the area of the outer flap seam 31 a seam tape 71a for sealing the obtuse angle is applied to the obtuse angle and a seam tape 73a for sealing the acute angle is applied to the acute angle. Both tapes are waterproof. The obtuse angle seam tape 71a bonds layer 19a of the main garment part 11a with the inner surface of connecting inner face laminate 61b. The acute angle seam tape 73a connects the inner surface of the inner face laminate 61b of outer flap 29 with the outer surface of the connecting inner face laminate flap 61b. In this way the obtuse angle seam tape 71a is partly on the functional layer 19 and partly on the monofil knit of the connecting inner face laminate 61b whereas the acute angle seam tape 73a is on monofil knit at both sides.

In the area of the intermediate flap seam 43 an obtuse angle tape 71b is applied to the obtuse angle between the main garment part 11b and the connecting inner face laminate 63b whereas an acute angle tape 73b is applied to the acute angle between the intermediate flap 41 and the connecting inner face laminate 63b. The tapes 71b and 73b, too, are of waterproof material and extend along the intermediate flap seam 43. The obtuse angle tape 71b links the functional layer 19b of the main garment part 11b with the inner surface of the connecting inner face laminate 63b and the acute angle tape 73b links the inner surface of the intermediate flap 41 with the outer surface of the connecting inner face laminate 63b. The tapes in the area of the intermediate flap seam 43, too, link either two surfaces of monofil knit or a surface of monofil knit and the layer 19b.

In this invention the inner and outer layers or sides are always described from the wearer's viewpoint. This means that in the figures outer surfaces or layers show upwards and inner surfaces or layers downwards. An exception is the folded part of the intermediate flap 41.

Since both connecting inner face laminates 61b and 63b are covered by waterproof layers, namely the waterproof functional layers within the inner face laminates 61a and 61b of outer flap 29 and intermediate flap 41, the connecting inner face laminates themselves would no longer have to incorporate a waterproof layer. For the version where the connecting inner face laminates 61b and 63b are formed by a continuation of the inner face laminates 61a and 63a of the outer flap 29 and the intermediate flap 41, the waterproof layer will be present within connecting inner face laminates 61b and 63b anyway. After this explanation of the structure of an embodiment of the invention the following will explain the ways the water may take.

Water contacting the face fabric 16a and 16b can creep around the free end 57 of the outer flap 29 and will then meet the monofil knit surface of the inner face laminate 61a of the outer flap 29.

Should water creep via the monofil knit surface towards the outer flap seam 31 it would be stopped at the latest at the acute angle seam tape 73a. In addition water which penetrates the functional layer through the outer flap seam 31 via the face fabric 16a contacts monofil knit surfaces whose wicking effect is interrupted by the obtuse and acute angle seam tapes 71a and 73a. Therefore, there is no way for the water to reach the connecting inner face laminate 61b and thus the zipper seam 25a and the lining 17a.

The same holds true for the main garment part 11b, the intermediate flap 41, the intermediate flap 43, the connecting inner face laminate 63b and the zipper seam 25b. Here, too, the water cannot reach the connecting inner face laminate 63b and the zipper seam 25b or the lining 17b.

To sum up, a garment with a closure and seam-sealed flaps according to the present invention offers a high degree of protection against the ingress of water into the garment.

It should be pointed out that waterproof functional layers 19a and 19b in the main garment parts 11a and 11b extend past outer flap seam 31 and past the intermediate flap seam 43 only up to the end of the corresponding acute angle seam tapes 73*a* and 73*b*. In a modified construction the functional layer may be continued up to the free end 57 of the outer flap 29 or the free end 55 of the intermediate flap 41 and be attached via outer flap end seam 39 or intermediate flap end seam 63 in this area.

In another modification a waterproof seam tape may be applied to the inner side of the flap 29 and/or to the inner side of the part of the intermediate flap 41 which has been folded and thus turned outside preferably in the vicinity of the free end 57 of the outer flap 29 or the free end 55 of the intermediate flap 41 running parallel to the free ends. This would stop water from creeping around the free end towards the inner side of outer flap 29 or the intermediate flap 41.

Another modification is to partly apply face fabric to the inner side of the outer flap 29 and the intermediate flap 41, or at least, to provide a strip whose surface is a monofil knit running parallel to and positioned near outer flap seam 31 or the intermediate flap seam 43.

I claim:

1. A waterproof garment comprising a textile face fabric (16*a*, 16*b*), a textile lining (17*a*, 17*b*) having an inner side, and a waterproof functional layer (19*a*, 19*b*) having an inner side and an outer side, the waterproof functional layer arranged in between the textile face fabric and the textile lining, the garment being equipped with a re-openable closure (15) in the form of a zipper, said garment also being equipped with an outer flap (29) which is connected to a main garment part (11*a*) adjacent to a longitudinal side of the closure, said outer flap having an inner side and an outer side and being located above the closure when the garment is closed, said garment also being equipped with an intermediate flap (41) which is connected to a main garment part (11*b*) adjacent to another longitudinal side of the closure (15), said intermediate flap having an outer side and an inner side and being located between the closure (15) and the outer flap (29) when the garment is closed, the outer sides of the outer flap (29) and the intermediate flap (41) each consisting of a textile face fabric (33*a*, 45*a*), the inner sides of the outer flap and the intermediate flap each consisting of inner face laminates (61*a*, 63*a*) containing a waterproof functional layer, said garment also being equipped with an outer flap seam (31) running parallel to the closure (15) at the place where the outer flap (29) is connected to the main garment part (11*a*), said garment also being equipped with an intermediate flap seam (43) running parallel to the closure (15) at the place where the intermediate flap (41) is connected to the main garment part (11*b*), wherein the inner face laminates (61*a*, 63*a*) of the outer flap (29) and the intermediate flap (41) do not come in contact with the textile face fabric at least in a region running parallel and adjacent to the outer flap seam (31) and the intermediate flap seam (43), and wherein a connecting inner face laminate (61*b*, 63*b*) having two ends is arranged on both sides of the closure (15), said connecting inner face laminate being sewn to the face fabric (16*a*, 16*b*) at the inner side of the waterproof functional layer (19*a*, 19*b*) of the main garment parts (11*a*, 11*b*) by means of the outer flap seam (31) and the intermediate flap seam (43) at one end, said connecting inner face laminate being connected at its other end together with the lining (17*a*, 17*b*) of the main garment parts (11*a*, 11*b*) to both sides of the closure (15), the surface of the inner face laminate being made of a monofil knit, a waterproof seam tape applied to an obtuse angle formed by the inner side of the functional layer (19*a*, 19*b*) and the connecting inner face laminate (61*b*, 63*b*) along the outer flap seam (31), a waterproof seam tape applied to acute angles formed by the outer flap (29) and the intermediate flap (41) and an outer surface of the connecting inner face laminate (61*b*, 63*b*).

2. A garment according to claim 1 wherein the waterproof functional layer (19*a*, 19*b*) of the main garment parts (11*a*, 11*b*) is made of a waterproof, water vapor-permeable material.

3. A garment according to claim 1 or 2 wherein the waterproof functional layer of the outer flap (29) and of the intermediate flap (41) is made of a waterproof, water vapor-permeable material.

4. A garment according to claim 2 characterized in that the waterproof, water vapor-permeable material is composed of expanded polytetrafluoroethylene (PTFE) with a microfibril structure.

5. A garment according to claim 3 characterized in that the waterproof, water vapor-permeable material is composed of expanded polytetrafluoroethylene (PTFE) with a microfibril structure.

6. A garment according to claim 1 or 2 wherein a free end (57) of the outer flap (29) and an end of the intermediate flap (41) which is connected or disconnected with the main garment part (11*b*) are provided with interacting closing mechanisms (59) by means of which the outer flap (29) can be connected with the intermediate flap (41).

7. A garment according to claim 1 or 2 wherein inner face laminates (61*a*, 63*a*) of the outer flap (29) and the intermediate flap (41) are provided with a layer made of a monofil knit, on their outer surfaces, covering the waterproof functional layer.

* * * * *